US007780045B2

(12) United States Patent
Rossignol

(10) Patent No.: US 7,780,045 B2
(45) Date of Patent: Aug. 24, 2010

(54) NON-VENTED LIQUID PRODUCT DISPENSER

(75) Inventor: Eric Rossignol, Chalon sur Saone (FR)

(73) Assignee: Rexam Dispensing SMT (FR)

( * ) Notice: Subject to any disclaimer, the term of this patent is extended or adjusted under 35 U.S.C. 154(b) by 790 days.

(21) Appl. No.: 11/561,227

(22) Filed: Nov. 17, 2006

(65) Prior Publication Data

US 2007/0084882 A1 Apr. 19, 2007

Related U.S. Application Data

(63) Continuation of application No. PCT/FR2005/001060, filed on Apr. 28, 2005.

(30) Foreign Application Priority Data

May 19, 2004 (FR) ..... 04 05452

(51) Int. Cl.
*B65D 88/54* (2006.01)

(52) U.S. Cl. ..... 222/322; 222/321.2; 222/402.13; 222/402.25; 222/501; 239/337; 239/353

(58) Field of Classification Search ..... 222/321.2, 222/322, 386, 518, 383.3, 402.13, 182, 402.15, 222/402.25, 501, 256; 239/337, 353
See application file for complete search history.

(56) References Cited

U.S. PATENT DOCUMENTS 5,085,353 A * 2/1992 Inui et al. ..... 222/402.13
5,205,443 A * 4/1993 Inui et al. ..... 222/402.13
5,465,873 A 11/1995 Mejean et al. ..... 222/47

FOREIGN PATENT DOCUMENTS

| | | | |
|---|---|---|---|
| DE | 42 10 225 | A1 | 9/1993 |
| EP | 0 461 894 | A2 | 12/1991 |
| FR | 2 838 070 | A | 10/2003 |
| WO | WO 02/30781 | A1 | 4/2002 |

OTHER PUBLICATIONS

International Search Report, Sep. 6, 2005, 3 pages.

* cited by examiner

*Primary Examiner*—Kevin P Shaver
*Assistant Examiner*—Melvin A Cartagena
(74) *Attorney, Agent, or Firm*—St. Onge Steward Johnston & Reens LLC

(57) ABSTRACT

The invention relates to a device which is used for the non-vented dispensing of liquid products from a container including a mobile base, an exhaust conduit and a push element which co-operates with a piston and a return spring. The invention is characterized in that the device includes a sealing and dosing bush bearing a sealing needle valve which can move in translation in a discharge channel in the bush, the needle valve being connected by means of a drive link to an axial guide rod which can slide in the exhaust conduit of the container that is connected to the channel by pressing on the bush and compressing the spring.

11 Claims, 4 Drawing Sheets

NON-VENTED LIQUID PRODUCT DISPENSER

CROSS-REFERENCE TO RELATED APPLICATIONS

The present application is a continuation of pending International patent application PCT/FR2005/001060, filed Apr. 28, 2005, which designates the United States and claims priority from French patent application FR 0405452, filed May 19, 2004, the content of which is incorporated herein by reference.

FIELD OF INVENTION

The invention relates to an airless device for dispensing liquid products and, more particularly, cosmetic or pharmaceutical products.

BACKGROUND OF THE INVENTION

Airless dispensers of liquid products generally comprise a reservoir equipped with a mobile base, an outlet duct and an actuator that cooperates with a piston and a return spring.

However, there are certain watertightness problems associated with these dispensers, in particular regarding the chamber of a given volume that contains the doses of the product to be dispensed. Another problem relates to the incompatibility of certain products with metal, which forbids any contact with the return spring.

Moreover, the dispensing method is poorly controlled, which is detrimental to the dosing of the product, especially when dispensing small volumes (several milliliters).

Additionally, it is difficult to manufacture and assemble the various parts that make up the dispenser, particularly the elements that provide the watertightness, in which their fineness and position are decisive factors in the production of a reliable, efficient dispenser.

The present invention aims to resolve these problems in a satisfactory manner.

SUMMARY OF THE INVENTION

This aim is achieved according to the invention by means of a device characterised in that it comprises a watertight dosage bush, which supports a blocking needle that can be moved in translation inside an outlet channel arranged in said bush, which is connected by a drive link to an axial guide rod that is capable of sliding in the outlet duct of the reservoir, which communicates with said channel, by pressing on said bush and compressing said spring.

According to an advantageous characteristic, said needle is solidly attached laterally to a set of spring plates, the free ends of which are attached to the bush.

According to another characteristic, said drive link is equipped with a hinge that connects it to said needle, allowing it to fold inside said channel from an extended moulding position.

According to yet another characteristic, said rod is equipped with a lateral lug that cooperates with a safety catch arranged on the inner wall of the outlet duct.

According to a first alternative embodiment, said rod is equipped with a longitudinal flat section that allows the product to pass through it into the outlet channel.

According to a second alternative embodiment, said link consists of a cam with a triangular cross-section, articulated at the bottom, respectively, to the rod and to the bush and, at the top, to a bevelled edge of the needle.

According to another alternative embodiment, said channel is equipped with upper deformable lips that allow the snap-fitting of the needle.

According to another characteristic, said bush comprises a central sleeve forming a piston designed to cover the outlet duct by delimiting a dosage chamber around said rod and above said duct.

Said bush preferably comprises a peripheral skirt surrounding said spring and having, at the bottom, a flange that is capable of coming to a stop against the top part of the reservoir at the end of the dose.

Advantageously, the bush of the invention is manufactured as a single part together with the needle, the link and the rod by injection moulding.

It is provided for said bush to be additionally associated with a cover forming an actuator and closing off said outlet channel at the top.

This cover forming an actuator preferably comprises an orifice in line with the axis of said channel, and the needle in watertight blocking position rests against its inner circumference.

Thanks to the retractable needle, the device of the invention ensures automatic watertightness of the dispenser.

The watertightness is additionally reinforced and secured by the action of the spring plates.

As for the link and rod, they make it possible to break down the mode used for dispensing the product, which therefore takes place in two steps to allow better control of the dose.

Moreover, the dosage chamber is arranged outside the product reservoir and inside the return spring, being isolated from the latter by the wall of the sleeve, thereby protecting the product from all contact with the metal elements.

Finally, the device of the invention can be manufactured as a single part by injection moulding and ensures a high rate of product recovery.

BRIEF DESCRIPTION OF THE DRAWINGS

The invention will be understood better from reading the following description, made in reference to the appended drawings, in which.

DETAILED DESCRIPTION OF THE INVENTION

Figure 1:
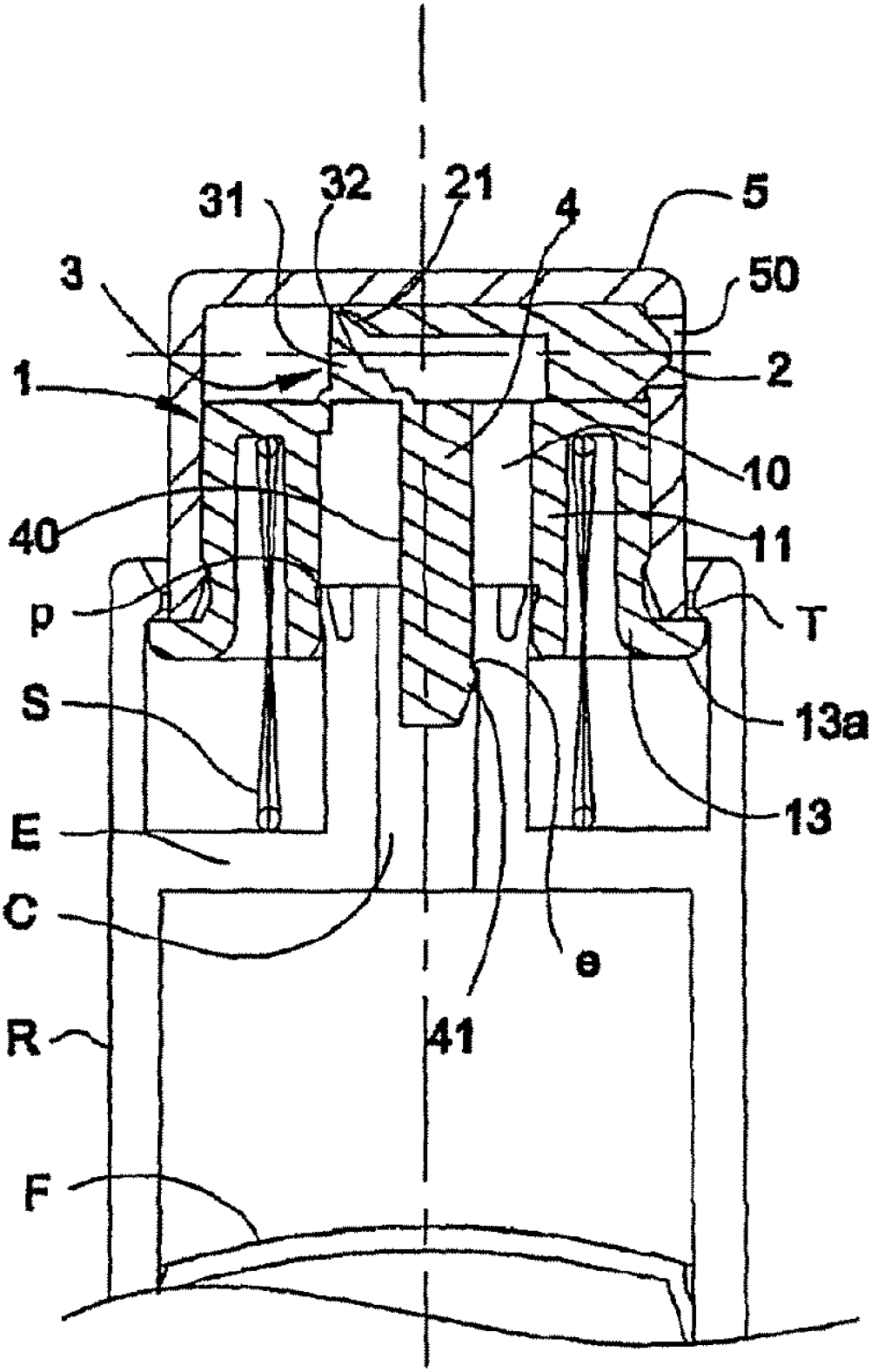
FIG. 1 shows a general axial cross-section view of one embodiment of the device according to the invention installed on an airless dispenser.

The device according to the invention as shown in the figures is designed for equipping an airless dispenser of liquid products and, more particularly, of cosmetic or pharmaceutical products, shown in FIG. 1.

This product is contained in a reservoir R which is equipped, at the bottom, with a mobile base F and, at the top, with a shoulder E that contains an outlet duct C for the product.

The dispenser is also equipped with an actuator intended to cooperate with a piston (described below) and a return spring S.

Figure 2A:
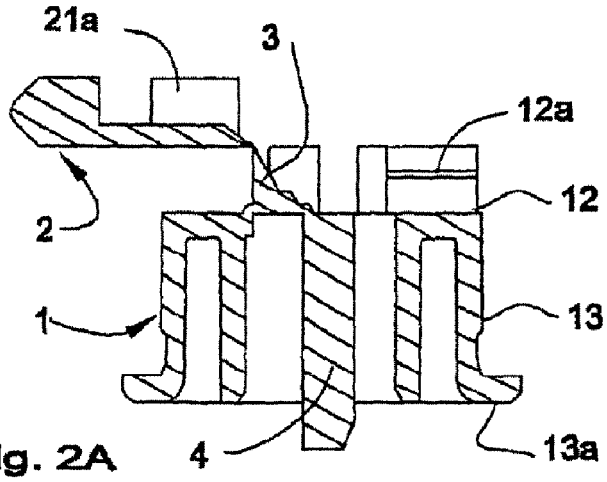
FIGS. 2A and 2B show cross-section views of the embodiment of the invention shown in FIG. 1, respectively after being removed from the mould and after installing the cover, before assembly on a dispenser.
Figure 2B:
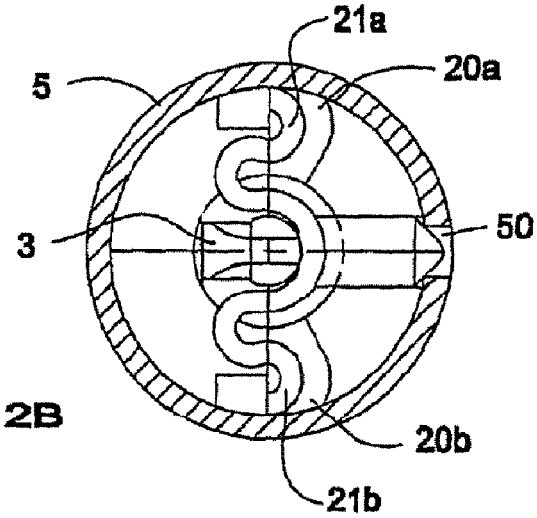

The device of the invention, as shown in particular in FIGS. 2A and 2B, comprises a watertight dosage bush 1 that supports a blocking needle 2. As shown in FIG. 2B, the needle 2 is designed to be inserted in an outlet channel 12, in this case arranged in the top face of the bush 1 after folding and snap-fitting from the extended position for removal from the mould shown in FIG. 2A, the device in this case being manufactured as a single part.

For this purpose, the channel 12 includes deformable lips 12*a* that stick out at the top and partially close off the channel.

The needle 2 can move in translation in the channel 12 by manually pushing on the bush 1 and compressing the spring S, being connected by a drive link 3 to an axial guide rod 4 that is capable of sliding in the outlet conduit C of the reservoir R when dispensing the product.

The drive link 3 is equipped with a hinge 32 that connects it to the needle 2 and allows it to fold.

This link consists of a cam 31 with a triangular cross-section articulated, at the bottom, respectively to the rod 4 and to the bush 1 and, at the top, to a bevelled edge 21 of the needle 2 via the hinge 32. The link 3 therefore has a swivel axis with each of the adjacent elements.

Figure 3:
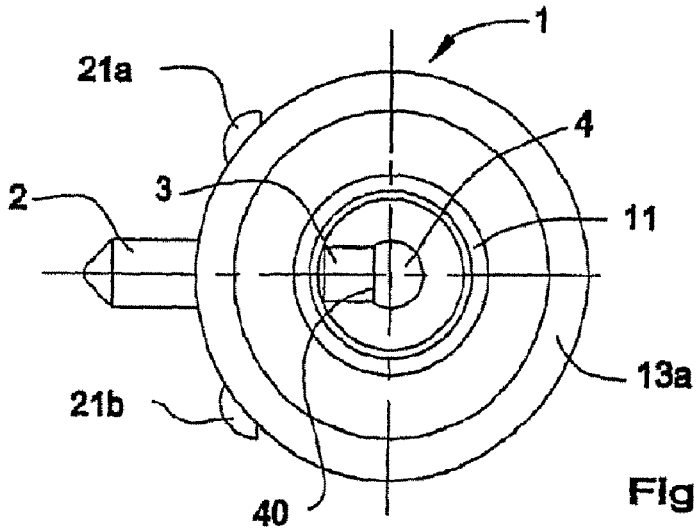
FIG. 3 shows the embodiment of the invention shown in the preceding figures in a view from below.

The rod 4 is inserted so as to slide freely inside the duct C, filling the inner volume of the duct except where it has a longitudinal flat section 40 (see FIG. 3), which allows the product to pass through said duct towards the channel 12. The rod 4 is also provided with a lateral lug 41 that cooperates with a safety catch e made on the inner wall of the duct C.

When the bush 1 is installed on the reservoir R, the rod 4 penetrates the duct C and the lug 41 snaps into position under the catch e.

The duct C communicates with the channel 12 by means of a dosage chamber 10 delimited inside a central sleeve 11, above the duct C and extending, in the bush 1, coaxially to the rod 4.

The sleeve 11 is designed such as to cover the duct C in a watertight manner, forming a piston.

In order to increase the watertightness of the chamber 10 forming the cylinder of the piston, the top edge of the duct C is advantageously equipped with a peripheral lip p.

The needle 2 is solidly attached laterally to a set of two spring plates 21*a*, 21*b* the free ends of which are fixed to the bush 1 by becoming blocked in two slots 20*a*, 20*b*, after the folding of the needle (see FIG. 2B). The spring plates 21*a*, 21*b* participate in returning, guiding and holding the needle in the position that blocks the channel 12 (see FIGS. 4A and 4D).

The bush 1 also comprises a peripheral skirt 13 that surrounds the spring S and comprises, at the bottom, a flange 13*a* that comes to a stop, at the end of the dispensing stage, against the shoulder E of the reservoir R.

Figure 4B:
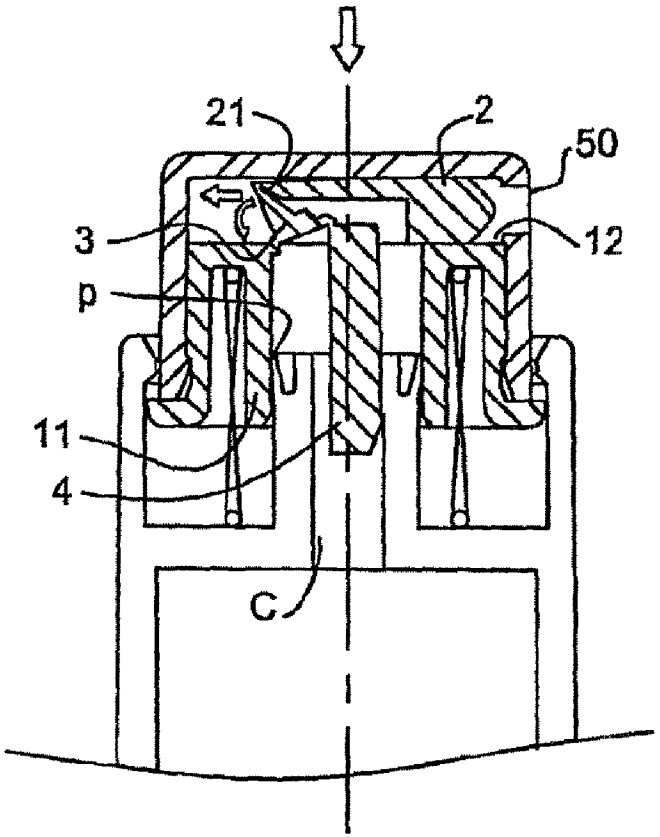
FIGS. 4A to 4E show the device of the invention during the consecutive phases of dispensing the product.
Figure 4A:
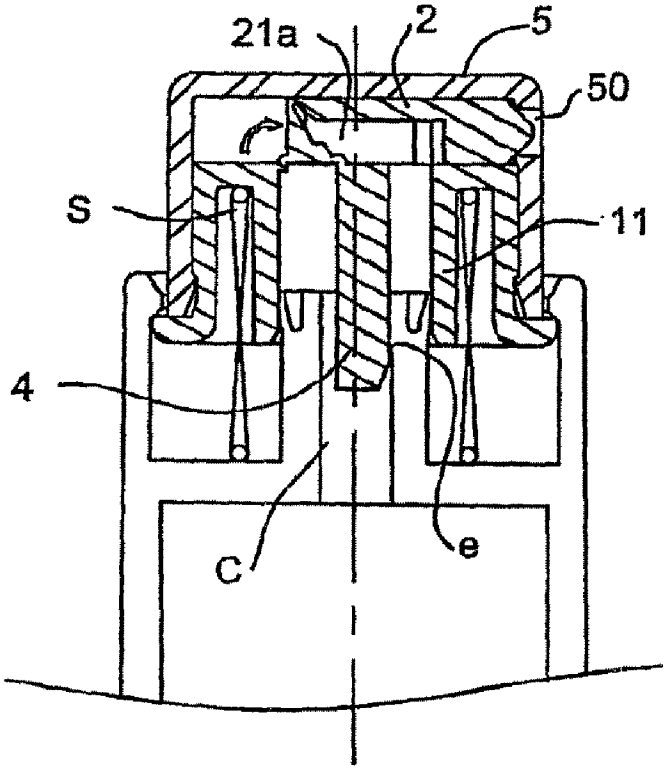
Figure 4E:
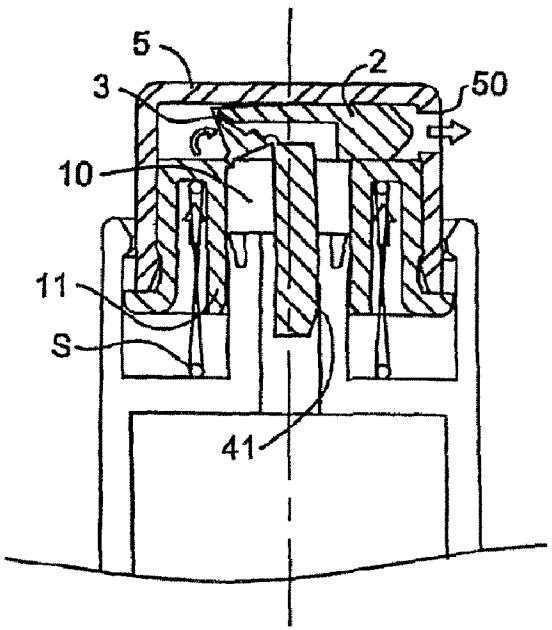

The flange 13*a* also cooperates with a radially projecting raised edge T made in the reservoir R which ensures that the bush 1 is held in its housing and that the spring S is kept under stress in the watertight closed position of the dispenser (see FIG. 4E).

The device of the invention additionally comprises a cover 5 forming an actuator which closes off the channel 12 in a watertight manner at the top.

This cover is, for example, snap-fitted (as in the alternative embodiment shown in the figures) or inserted onto the bush 1.

The cover 5 comprises a lateral ejection orifice 50, possibly associated with a nozzle, the end of the needle 2 resting against its inner circumference in the position in which it blocks the dispenser in a watertight manner.

When necessary, in order to increase the watertightness, the inner circumference of the orifice 50 is equipped with an angular ring forming a seat for the end of the needle 2.

The operation of the device is described below in reference to FIGS. 4A to 4E.

In the resting position shown in FIG. 4A, the end of the needle 2 is resting against the orifice 50 of the cover 5, under the simultaneous action of the spring plates 21*a*, 21*b* and the spring S, which is under slight stress, thus hermetically blocking the channel 12 and, more generally, the whole dispenser.

At the same time, while the sleeve 11 is pushed upwards, the rod 4 is pulled downwards into the duct C by the safety catch e, contributing to the rotation torque to which the link 3 is subjected in clockwise direction (see arrows), thus increasing the pressure on the needle 2.

The position shown in FIG. 4B corresponds to the start of the product dispensing phase, the cover/actuator 5 beginning its descent in response to the vertical manual pressure exerted by the consumer.

Throughout this phase, the rod 4 remains immobile due to the inevitable friction involved in its sliding insertion in the duct C.

As for the sleeve 11, it begins its descent by compressing the spring S and subjecting the link 3 to a rotation torque in anticlockwise direction. This movement drives the translation movement of the needle 2 towards the rear and its retraction from the ejection orifice 50.

At the same time, the dosage chamber empties gradually by the piston effect of the sleeve 11, the scraping of its wall by the lip p of the duct C causing the product to be dispensed through the channel 12 and the orifice 50.

While the pressure is maintained, the movement continues until the link 3 comes to a stop against the bevelled edge 21 of the needle 2, as shown in FIG. 4B.

The dispenser is then fully open.

Figure 4D:
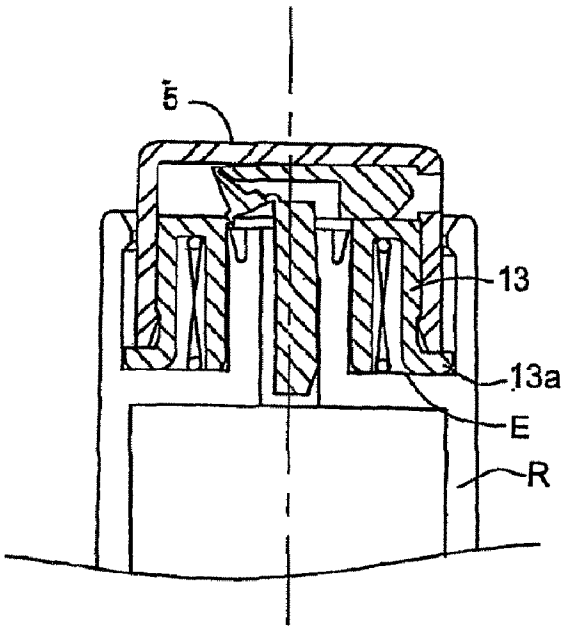
Figure 4C:
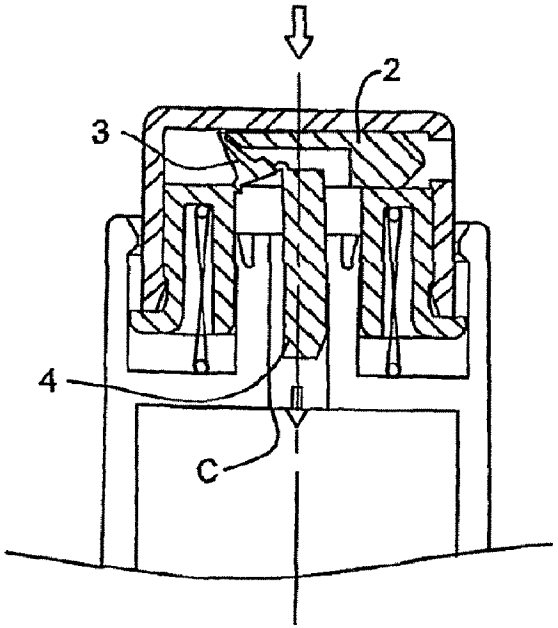

In the position shown in FIG. 4C, the clamping of the rod 4 in the duct C is ended by the forces pushing on the actuator 5. The rod 4 begins to slide towards the bottom inside the duct C, while the link remains resting against the needle 2, thereby moving towards reaching the dosage that is finally obtained when the flange 13*a* of the skirt 13 of the bush reaches the shoulder E of the reservoir R (FIG. 4D).

FIG. 4E shows the return to the resting position of FIG. 4A. The release of the manual force causes the release of the spring S. This release initially causes the sleeve 11 and the actuator 5 to rise until the needle 2 comes to a stop against the orifice 50, the rod 4 remaining immobilised in the duct C.

The link 3 swivels in clockwise direction and pushes the needle 2 back against the orifice 50. This movement causes the suction of the product in the reservoir R and the gradual filling of the chamber 10 inside the sleeve 11.

Then, the clamping of the rod 4 in the duct ends and the rod 4 rises back up until its lug 41 comes to a stop against the catch e of the duct C, the needle being held in its forward position by the action of the spring plates 21*a*, 21*b*.

The spring S is then held under slight stress due to the flange 13*a* having come to an anticipated stop against the projecting raised edge T of the reservoir R.

What is claimed is:

1. Airless device for dispensing liquid products from a reservoir equipped with a mobile base, an outlet duct and an actuator that cooperates with a piston and a return spring, characterised in that it comprises a watertight, dosage bush supporting a blocking needle that can be moved in translation inside an outlet channel arranged in said, bush, connected by a drive link to an axial guide rod that is capable of sliding in the outlet conduit of the reservoir communicating with said channel, by pressing on said bush and compressing said spring, and further characterised in that the bush, the needle, the link and the rod are a single injection moulded part.

2. Device according to claim 1, characterised in that said needle is solidly attached laterally to a set of spring plates, the free ends of which are attached to the bush.

3. Device according to claim 1, characterised in that said drive link is equipped with a hinge that connects it to said needle allowing it to fold inside said channel from an extended moulding position.

4. Device according to claim 1, characterised in that said rod is equipped with a lateral lug that cooperates with a safety catch arranged on the inner wall of the outlet duct.

5. Device according to claim 1, characterised in that said rod is equipped with a longitudinal flat section that allows the product to pass through it into the outlet channel.

6. Device according to claim 1, characterised in that said channel is equipped with deformable upper lips that allow the snap-fitting of the needle.

7. Device according to claim 1, characterised in that said bush comprises a central sleeve forming a piston designed to cover the outlet duct by delimiting a dosage chamber around said rod and above said duct.

8. Device according to claim 1, characterised in that said bush comprises a peripheral skirt surrounding said spring and having, at the bottom, a flange that is capable of coming to a stop against the top part of the reservoir at the end of the dose.

9. Device according to claim 1, characterised in that it additionally comprises a cover forming an actuator and closing off said outlet channel at the top.

10. Device according to claim 9, characterised in that said cover comprises an orifice in line with an axis of said channel, and the needle in watertight blocking position rests against an inner circumference of said orifice.

11. An airless device for dispensing liquid products from a reservoir equipped with a mobile base, an outlet duct and an actuator that cooperates with a piston and a return spring, characterized in that it comprises a watertight, dosage bush supporting a blocking needle that can be moved in translation inside an outlet channel arranged in said bush, connected by a drive link to an axial guide rod that is capable of sliding in the outlet conduit of the reservoir communicating with said channel, by pressing on said bush and compressing said spring, characterized in that said link consists of a cam with a triangular cross-section articulated, at the bottom, respectively to the rod and to the bush and, at the top, to a bevelled edge of the needle.

* * * * *